United States Patent [19]

Irwin

[11] 3,981,142

[45] Sept. 21, 1976

[54] CERAMIC COMBUSTION LINER

[75] Inventor: John A. Irwin, Indianapolis, Ind.

[73] Assignee: General Motors Corporation, Detroit, Mich.

[22] Filed: Apr. 1, 1974

[21] Appl. No.: 456,603

[52] U.S. Cl. ..... 60/39.65; 60/39.66; 431/352

[51] Int. Cl.[2] ..... F02G 3/00; F23D 15/02

[58] Field of Search ..... 60/39.65, 39.66, 200 A, 60/39.69; 431/352, 116

[56] References Cited

UNITED STATES PATENTS

| | | | |
|---|---|---|---|
| 2,601,390 | 6/1952 | Hague | 60/39.65 X |
| 2,725,929 | 12/1955 | Massier | 60/39.65 |
| 2,742,762 | 4/1956 | Kuhring | 60/39.65 |
| 3,545,202 | 12/1970 | Batt et al. | 60/39.65 |
| 3,594,109 | 7/1971 | Penny | 60/39.65 X |
| 3,918,255 | 11/1975 | Holden | 60/39.65 |

*Primary Examiner*—Carlton R. Croyle
*Assistant Examiner*—Thomas I. Ross
*Attorney, Agent, or Firm*—Paul Fitzpatrick

[57] ABSTRACT

A combustion liner for a gas turbine combustion apparatus has a wall of ceramic material. To minimize destructive thermal gradients in the ceramic material due to local cooling by air entering the liner through ports for combustion or dilution air, the walls of these ports are isolated from the entering air by a lining for the port, either a coating applied to the wall of the port or a metal or ceramic sleeve extending through the port.

5 Claims, 9 Drawing Figures

CERAMIC COMBUSTION LINER

My invention is directed to combustion apparatus such as is employed in gas turbine engines. Particularly, it is directed to improvements in ceramic combustion liners operative to reduce thermal gradients attendant upon the entrance of air into the liner through the usual ports.

It is well known that combustion apparatus of the sort employed in gas turbine engines ordinarily includes an outer housing or casing to which compressed air is introduced and a combustion liner into which the air flows from the housing and within which combustion takes place between the air so entering and fuel which is sprayed or otherwise diffused within the liner. In such devices, the combustion is quite intense and the heat is high; in fact, in many cases the air entering the combustion apparatus is at about 1000°F. and often it is at 2000°F. or higher at discharge from the combustion apparatus. The maximum temperature in the flame zone may be 3000°F. or higher.

Typical prior art combustion apparatuses have employed combustion liners of high temperature resistant metal alloys. These have been quite successful, but are also quite expensive.

It appears highly desirable to find a satisfactory way to substitute molded ceramic liners or portions of liners for the metal liners previously employed. High temperature resisting ceramic compositions may be formed or molded and fired to provide accurately dimensioned parts of very high temperature resisting capabilities which have some advantages other than cost over the metal structures referred to above. However, there are difficulties attendant upon the use of such ceramics, among them being the likelihood of cracking or breakage of the ceramic material due to stresses resulting from thermal gradients. Such gradients cause high stresses in the ceramic material, which is brittle rather than ductile as in the case of the metal liner.

In the usual combustion liner the air for combustion is introduced through ports in the wall of the liner and dilution air is introduced through ports at the downstream end of the combustion zone of the liner to reduce the temperature of the combustion products. Obviously, with a liner in which intense combustion is taking place, the ceramic wall will be very hot. On the other hand, the combustion air entering through the ports is ordinarily at least 1000° cooler than the flame temperature. It is inconsistent with satisfactory service life of the ceramic to have the margins of the air ports cooled by the entering air to a temperature much lower than the immediately surrounding parts of the liner wall.

My present invention is based upon the concept of providing means lining these ports in the liner so as to isolate the ceramic wall material from the entering air.

The principal objects of my invention are to provide an improved gas turbine combustion apparatus of lower cost, to provide a ceramic combustion liner wall structure best adapted to meet the requirements of practice, to provide simple, reliable, and inexpensive means for protecting the ceramic liner walls from combustion or dilution air entering through ports in the wall, and to provide improved and highly suitable arrangements for lining the port and thus isolating the liner wall from the entering air.

The nature of my invention and its advantages will be apparent to those skilled in the art from the succeeding detailed description of preferred embodiments of the invention and the accompanying drawings of them.

Before proceeding with the description of the embodiments of my invention, I call attention to Penny U.S. Pat. No. 3,594,109, issued July 20, 1971, which shows a ceramic lining for a metal combustion liner or flame tube, and in which bushings extending through the air holes of the liner are fixed to the metal wall.

Figure 1:
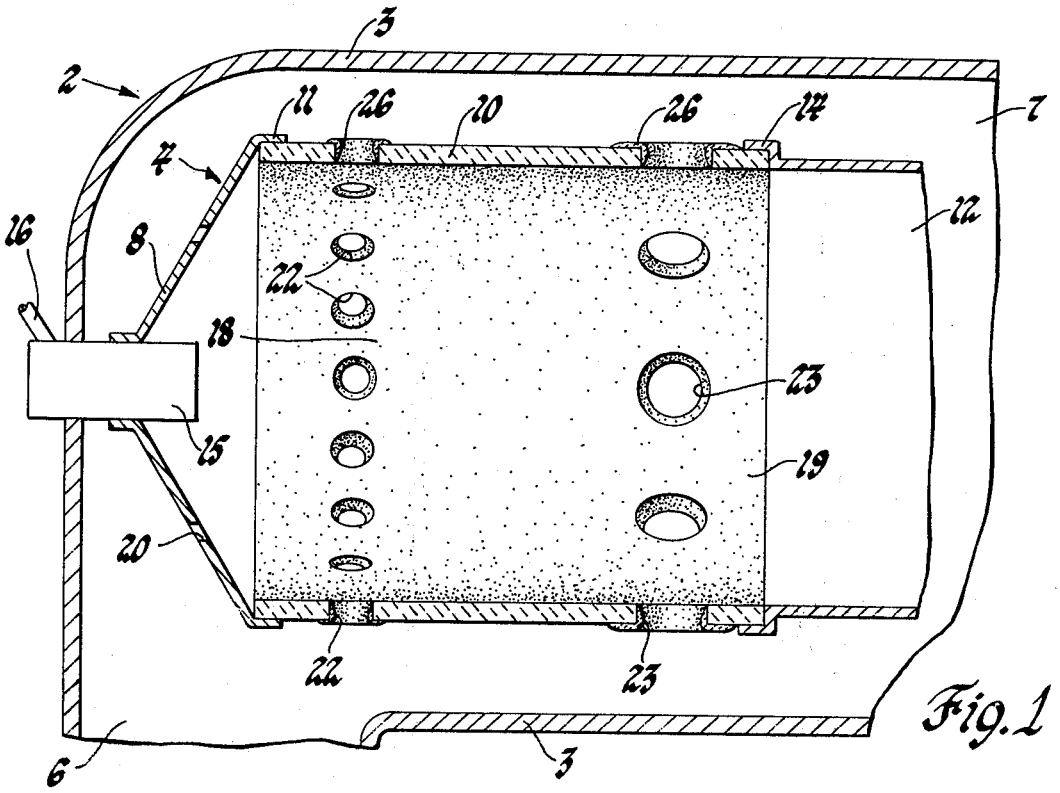
FIG. 1 is a schematic illustration of a gas turbine combustion apparatus incorporating a ceramic liner wall, taken in a plane containing the axis of the liner.

FIG. 1 shows somewhat schematically one form of general arrangement of a gas turbine combustor incorporating a ceramic liner wall. The combustion apparatus 2 includes a housing 3 enclosing a generally cylindrical space within which a combustion liner 4 is mounted. Compressed air for combustion may enter the housing through an air entrance 6. The other end of the housing may be closed by means not illustrated. Alternatively, the compressed air might enter through the downstream end 7 of the housing, and the air entrance 6 could be closed. The combustion liner 4 includes a dome or upstream end closure 8 and a side wall 10 preferably of circular cross section. The side wall is made of a suitable ceramic material; for example, silicon carbide. The side wall is inserted within a peripheral flange 11 of the dome at its upstream end and its downstream end is coupled to a duct 12 which conducts the combustion products to a turbine or other user (not illustrated). As shown, the downstream end of the liner is seated in an enlarged seat 14 at the upstream end of duct 12. The wall 10 is thus supported by dome 8 and duct 12. As illustrated, the upstream end of the liner is supported by a fuel nozzle 15 mounted in the wall of housing 3, to which fuel is supplied by a fuel line 16.

The liner defines a combustion zone indicated generally at 18 toward the upstream end of the liner 10 and a dilution zone indicated at 19 toward the downstream end of the liner. Some air for combustion may enter through the fuel nozzle. More air ordinarily enters through ports such as those indicated as 20 in the dome and, generally, the greater part of the combustion air enters through one or more rows of ports 22 distributed circumferentially around the liner. The structure of dome 8 may be similar to that illustrated in U.S. Pat. No. 3,656,298 of Wade issued Apr. 18, 1972, except that there is no air admission at the outer edge of the dome.

Dilution air, which ordinarily is of greater quantity than combustion air, may enter the liner through a circumferential row of larger ports 23 toward the downstream end of the liner. Except for the presence of a ceramic liner wall, the structure of the engine and of the combustion apparatus may be similar to those described in U.S. Pat. Nos. as follows: Collman et al. No. 3,077,074, Feb. 12, 1963; Collman et al. No. 3,267,674, Aug. 23, 1966; and Bell No. 3,490,746, Jan. 20, 1970.

As to all the air ports 22 and 23, it will be apparent that relatively cool air flowing through the ports at fairly high velocity will tend to cool the liner wall 10 immediately in the vicinity of the ports to a temperature substantially below that of the adjoining portions of the wall. Such thermal gradients set up mechanical stresses in the material which have been found in practice to result in spalling or cracking of the liner wall which may render it unfit for service in an undesirably short time.

Figure 2:
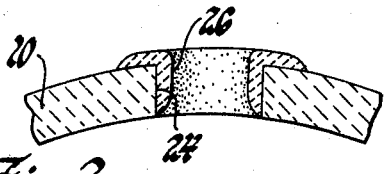
FIG. 2 is a fragmentary transverse sectional view of a liner as in FIG. 1 including a first form of means for protecting the liner from entering air.

My invention is directed to providing simple, reliable, and inexpensive means to overcome this problem by channeling the flow into the liner through liners, sleeves, coatings, or the like which isolate the ceramic material from direct contact with the inflowing compressed air. Various physical forms or embodiments of the invention are illustrated in FIGS. 2 through 9 of the drawings. It will be understood that any of these forms could be employed with the liner structure illustrated in FIG. 1. That of FIG. 2 is shown in FIG. 1. In FIGS. 2 through 9 the liner wall 10 of FIG. 1 is illustrated fragmentarily, but sufficiently to illustrate the structure of the particular embodiment. In all of FIGS. 2 through 9 the air hole shown is intended to illustrate either a primary air port 22 or a dilution air port 23.

Referring to FIG. 2, the liner wall 10 and an air port 24 are illustrated. The lining 26 in this case is a coating sprayed on in molten condition by flame spraying or plasma arc spraying devices. These melt a powder and project it onto the area to be coated. The material of the coating is preferably pyrex glass, which is a high temperature resisting glass with a high silica content, or zirconium oxide, $ZrO_2$. The primary virtue of these linings or coatings is low heat conductivity, which provides an insulating barrier between the material of the liner wall 10 and the air entering through the port 24. Another feature of the coating sometimes desired is that it be slightly plastic; that is, able to yield without breaking, at high temperature. Thus, it can accommodate to expansion or contraction of the ceramic. It is desirable for the coating and the liner wall material to have compatible coefficients of thermal expansion, however. In varying conditions of operation of the combustion apparatus, particularly during starting and shutdown and over varying levels of heat release, the temperatures of the liner wall and of the lining of the ports will not necessarily vary in the same ratio of absolute temperatures.

Figure 5:
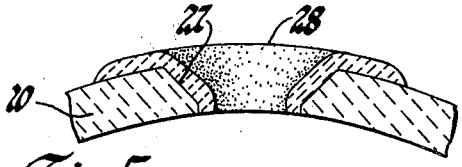
FIG. 5 is a similar view of a fourth form.

FIG. 5 also illustrates a flame-sprayed coating. In this case the coating is applied to a generally funnel-shaped port 27 in the liner and the lining 28 conforms to the shape of the port.

Figure 4:
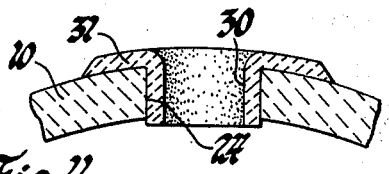
FIG. 4 is a view similar to FIG. 2 of a third form of the invention.

FIG. 4 shows an installation in which a cylindrical air port 24 is lined by a lining member 30 including a flange 31 abutting the exterior surface of the liner wall. In this case, the lining member is formed separately, fitted into place in the port 24, and the margin of flange 31 is melted by a flame or torch to fuse the margin of the lining member to the wall and retain the lining in place.

Figure 3:
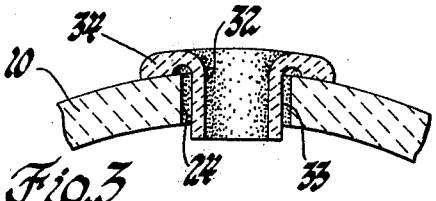
FIG. 3 is a similar view of a second form.

FIG. 3 illustrates another embodiment in which the lining member, indicated as 32, is inserted into a cylindrical hole 24. In this case also the lining member is cast separately. It includes a cylindrical body 33 spaced from the liner wall and a recurved flange 34 the margin of which bears against the outer surface of the liner wall. In this case, the lining member is bonded in place by use of any suitable means of cementing or brazing it to the wall. For example, a pure silicon or a suitable metallic braze compound known in the art, or even a cement of the type known as Sauereisen cement, may be employed. The lining member is held in place with the bonding material between the flange 34 and the wall, and the liner is then heated to complete the cementing operation.

Thus it will be seen that bonding can be achieved by applying a coating in a molten state, by melting a previously applied coating locally, or by cementing or brazing a finished lining member to the liner wall.

In all of the forms of FIGS. 2 to 5 the low thermal conductivity of the liner or lining member is important in minimizing transfer of heat from the wall to the air entering through the ports 24 or 27.

In the forms illustrated in FIGS. 6 through 9, the liner wall is protected by a lining in the form of a metallic sleeve which is retained by a ceramic member bonded to the outer surface of the liner. The bonding may be as described above with respect to FIG. 3.

Figure 6:
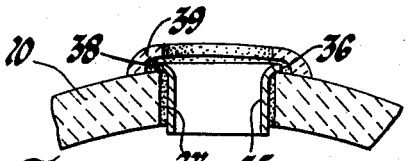
FIG. 6 is a view similar to FIG. 2 of a fifth form of the invention.

In FIG. 6, a metallic liner 35 is provided which has an outwardly directed flange 36 at its outer end bearing against the outer surface of the liner or, in other words, against the lip 38 of port 24. The liner is retained by a ceramic ring 39 bonded to the wall. It will be noted that the body of the lining 35 is spaced slightly from the wall of port 24 to leave a dead air zone between the wall and lining and minimize conduction of heat from the wall into the lining.

Figure 7:
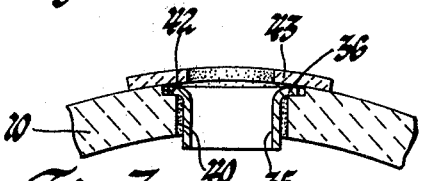
FIG. 7 is a similar view of a sixth form.

The structure of FIG. 7 is similar to that of FIG. 6 except that in this case the flange 36 of the lining member is received in a counterbore 42 at the outer end of the air port indicated at 40. In this structure a substantially flat ceramic washer 43 bonded to the liner wall retains the lining member 35.

Figure 8:
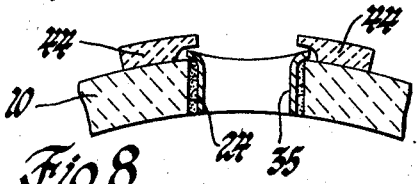
FIG. 8 is a view similar to FIG. 2 of a seventh form of the invention.

In FIG. 8, the lining member 35, which is of the same character as that in FIG. 6, is retained by two ceramic blocks 44 bonded to the wall and having portions projecting over the flange of the lining.

Figure 9:
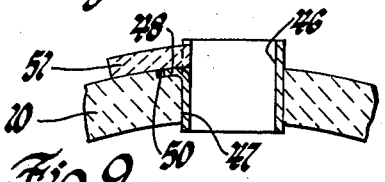
FIG. 9 is a view similar to FIG. 2 of an eighth form of the invention.

The installation of FIG. 9 differs from the last three described in that the lining sleeve 46 is a relatively close fit in the bore 47 providing the air port. It must, of course, be sufficiently loose under some conditions that it does not tend to split the liner in the event of greater expansion of the metal than the ceramic liner wall. The lining sleeve 46 bears a tab 48 struck out from its wall which is received in a small slot 50 in the outer surface of the liner wall. The lining sleeve is retained by a ceramic block 51 bonded to the liner wall and overlying the tab 48.

It will be apparent that the retaining structures of FIGS. 6, 7, and 8 can be applied or used with linings which fit rather closely in the air port as in FIG. 9. However, it seems preferable to provide the additional resistance to heat transfer by the gap between the lining and the wall of the liner port in which it is fitted.

It should be apparent to those skilled in the art that the various modes of implementing my invention which have been described are all adapted to achieving the desired result of minimizing local cooling of the liner wall at the points of air entry. It will also be apparent that they are all technically feasible and require only simple parts or simple processing steps.

The detailed description of the preferred embodiments of the invention for the purpose of explaining the principles thereof is not to be considered as limiting or resticting the invention, since many modifications may be made by the exercise of skill in the art.

I claim:

1. A combustion apparatus comprising, in combination, a housing adapted to be supplied with air, a combustion liner within the housing defining a space for combustion of fuel, the liner having a wall of ceramic material defining the exterior of the liner and defining spaced ports through the wall for admission of air into the liner from within the housing, the major part of the exterior surface of the liner being exposed to the air within the housing, the air being significantly cooler than the liner in normal operation of the combustion apparatus, and means for reducing thermal stresses in the wall due to local cooling of the wall by air streams entering through the wall by reducing transfer of heat from the wall to the streams, the said means comprising a lining for each port extending through the port, the lining isolating the wall from the air stream and having structure resisting heat transfer from the wall through the lining into the air stream, the lining being a coating on the wall of the port which is bonded to the wall and which coating is of a material sufficiently plastic at normal operating temperature to yield without breaking in accommodation to expansion and contraction of the wall.

2. An apparatus as defined in claim 1 in which the coating is a high temperature resisting glass.

3. An apparatus as defined in claim 1 in which the coating is essentially zirconium oxide.

4. A combustion apparatus comprising, in combination, a housing adapted to be supplied with air, a combustion liner within the housing defining a space for combustion of fuel, the liner having a wall of ceramic material defining the exterior of the liner and defining spaced ports through the wall for admission of air into the liner from within the housing, the major part of the exterior surface of the liner being exposed to the air within the housing, the air being significantly cooler than the liner in normal operation of the combustion apparatus, and means for reducing thermal stresses in the wall due to local cooling of the wall by air streams entering through the wall by reducing transfer of heat from the wall to the streams, the said means comprising a lining for each port extending through the port, the lining isolating the wall from the air stream and having structure resisting heat transfer from the wall through the lining into the air stream, and means bonding the lining to the wall for retaining the lining in place, the lining being a sleeve loosely fitting in the port out of contact with the wall of the port over most of the length of the sleeve and having a flange overlying the wall at the entrance to the port, and a ceramic part overlying the said flange and bonded to the liner wall to retain the sleeve in place.

5. A combustion apparatus comprising, in combination, a housing adapted to be supplied with air, a combustion liner within the housing defining a space for combustion of fuel, the liner having a wall of ceramic material defining the exterior of the liner and defining spaced ports through the wall for admission of air into the liner from within the housing, the major part of the exterior surface of the liner being exposed to the air within the housing, the air being significantly cooler than the liner in normal operation of the combustion apparatus, and means for reducing thermal stresses in the wall due to local cooling of the wall by air streams entering through the wall by reducing transfer of heat from the wall to the streams, the said means comprising a lining for each port extending through the port, the lining isolating the wall from the air stream and having structure resisting heat transfer from the wall through the lining into the air stream, and means bonding the lining to the wall for retaining the lining in place, the lining being a sleeve fitting in the port having a tab overlying the wall within a recess at the entrance to the port, and the retaining means being a ceramic part overlying the said tab and bonded to the liner wall.

* * * * *